US009357827B2

(12) United States Patent
Grabo

(10) Patent No.: US 9,357,827 B2
(45) Date of Patent: Jun. 7, 2016

(54) MASCARA DEVICES

(71) Applicant: Judith L. Grabo, Denver, CO (US)

(72) Inventor: Judith L. Grabo, Denver, CO (US)

( * ) Notice: Subject to any disclaimer, the term of this patent is extended or adjusted under 35 U.S.C. 154(b) by 0 days.

(21) Appl. No.: 14/616,067

(22) Filed: Feb. 6, 2015

(65) Prior Publication Data

US 2016/0106197 A1 Apr. 21, 2016

Related U.S. Application Data

(60) Provisional application No. 62/066,220, filed on Oct. 20, 2014.

(51) Int. Cl.
*A45D 40/24* (2006.01)
*A45D 40/26* (2006.01)

(52) U.S. Cl.
CPC ..... *A45D 40/24* (2013.01); *A45D 40/265* (2013.01)

(58) Field of Classification Search
CPC combination set(s) only.
See application file for complete search history.

(56) References Cited

U.S. PATENT DOCUMENTS

D300,269 S * 3/1989 Cassai ..... 401/126
4,886,080 A * 12/1989 Cole ..... A45D 40/265 132/317
4,972,858 A 11/1990 Beck et al.
5,052,839 A 10/1991 Pettengill
5,349,972 A 9/1994 Dirksing et al.
6,325,071 B1 12/2001 Butcher
6,464,418 B1 * 10/2002 Visser ..... A45D 33/00 206/509
7,287,923 B1 * 10/2007 Chen ..... A45D 40/24 132/317
7,473,045 B2 * 1/2009 Dumler ..... A45D 40/24 401/17
9,107,487 B2 * 8/2015 Gueret ..... A45D 40/267
2008/0000494 A1 1/2008 Sek
2009/0044824 A1 2/2009 Stachowski
2009/0272395 A1 11/2009 Carey
2011/0005541 A1 1/2011 Carter

OTHER PUBLICATIONS

K-Mart Advertisement for Maybelline Eye Cosmetics; published May 18, 2014.

* cited by examiner

*Primary Examiner* — David Walczak
(74) *Attorney, Agent, or Firm* — Faegre Baker Daniels LLP

(57) ABSTRACT

A mascara device includes a housing. The housing includes a first mascara-carrying chamber and a second mascara-carrying chamber. A first mascara applicator is removably carried by the housing within the first mascara-carrying chamber. The first mascara applicator includes a first applicator tip that is adapted to apply mascara to eyelashes of a wearer. The first applicator tip includes a circular cross-sectional outer perimeter shape. A second mascara applicator is removably carried by the housing within the second mascara-carrying chamber. The second mascara applicator includes a second applicator tip that is adapted to apply mascara to the eyelashes of the wearer. The second applicator tip includes a semi-circular cross-sectional outer perimeter shape.

5 Claims, 9 Drawing Sheets

MASCARA DEVICES

CROSS-REFERENCE TO RELATED APPLICATION

This application claims the benefit of U.S. Provisional Patent Application Ser. No. 62/066,220, filed on Oct. 20, 2014 and entitled "MASCARA DEVICES", which is incorporated by reference herein in its entirety for all purposes.

TECHNICAL FIELD

The present invention relates to mascara devices. More specifically, the present invention relates to mascara devices that include multiple mascara applicators and/or multiple mascara-holding chambers.

BACKGROUND

Mascara devices are commonly used to apply mascara and thereby darken the eyelashes of a wearer. Typically, mascara devices include a housing or "tube" that contains mascara. The housing removably receives an applicator or "brush". The brush is manipulated by the wearer to apply mascara to the eyelashes.

Previous mascara devices typically have one or more drawbacks. For example, mascara tubes and brushes are typically compact, lightweight, and simple structures that facilitate device portability. However, this simplicity typically inhibits a mascara brush from accessing a significant amount of the mascara carried in the tube. As a result, a significant amount of the mascara carried in the tube is often wasted. As another example, mascara brushes are not typically suitable for use with both the upper and lower eyelashes due to their different positions relative to other facial features.

SUMMARY

A mascara device according to some embodiments of the present invention includes a housing. The housing includes a first mascara-carrying chamber and a second mascara-carrying chamber. A first mascara applicator is removably carried by the housing within the first mascara-carrying chamber. The first mascara applicator includes a first applicator tip that is adapted to apply mascara to eyelashes of a wearer. The first applicator tip includes a circular cross-sectional outer perimeter shape. A second mascara applicator is removably carried by the housing within the second mascara-carrying chamber. The second mascara applicator includes a second applicator tip that is adapted to apply mascara to the eyelashes of the wearer. The second applicator tip includes a semi-circular cross-sectional outer perimeter shape.

A mascara device according to some embodiments of the present invention includes a housing. The housing includes a first mascara-carrying chamber. The first mascara-carrying chamber includes a first opening, and the first opening faces in a first direction. The housing further includes a second mascara-carrying chamber. The second mascara-carrying chamber includes a second opening, and the second opening faces in a second direction that is opposite the first direction. A first mascara applicator extends through the first opening and is carried by the housing within the first mascara-carrying chamber. The first mascara applicator includes a first applicator tip that is adapted to apply mascara to eyelashes of a wearer. The first applicator tip includes a first cross-sectional outer perimeter shape. A second mascara applicator extends through the second opening and is carried by the housing within the second mascara-carrying chamber. The second mascara applicator includes a second applicator tip that is adapted to apply mascara to the eyelashes of the wearer. The second applicator tip includes a second cross-sectional outer perimeter shape. The second cross-sectional outer perimeter shape is smaller than the first cross-sectional outer perimeter shape, and the second cross-sectional outer perimeter shape is a portion of the first cross-sectional outer perimeter shape.

A mascara device according to some embodiments of the present invention includes a housing. The housing includes a main housing portion that includes a main housing chamber. A first cartridge removably is carried by the main housing portion within the main housing chamber. The first cartridge includes a first mascara-carrying chamber. A second cartridge is removably carried by the main housing portion within the main housing chamber. The second cartridge includes a second mascara-carrying chamber. A mascara applicator includes an applicator tip that is adapted to apply mascara to eyelashes of a wearer. The first mascara-carrying chamber receives the applicator tip when the first cartridge is carried by the main housing portion, and the second mascara-carrying chamber receives the applicator tip when the first cartridge is removed from the main housing portion.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

It should be understood that the drawings are intended to facilitate understanding of exemplary embodiments of the present invention are not necessarily to scale.

DETAILED DESCRIPTION

Figure 1:
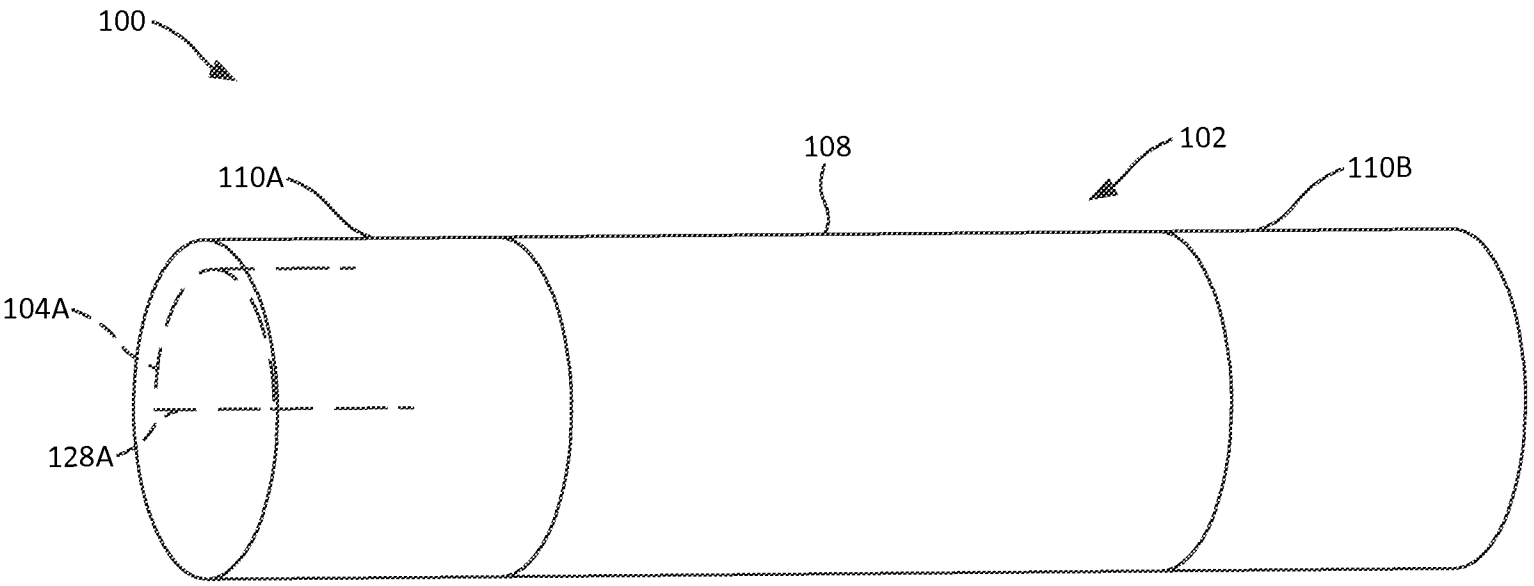
FIG. 1 illustrates a perspective view of a mascara device according to an embodiment of the present invention.
Figure 2:
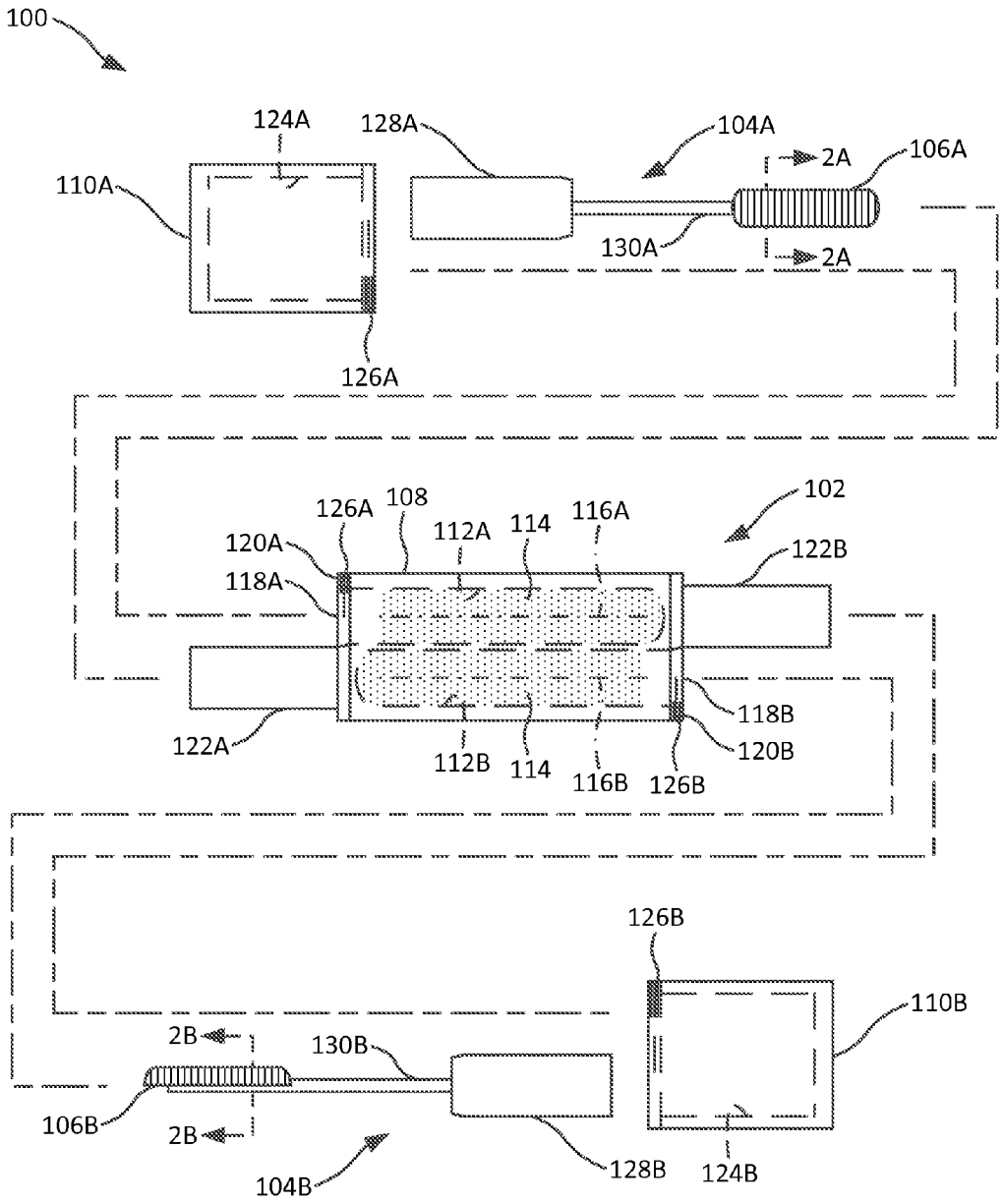
FIG. 2 illustrates an exploded side view of the mascara device of FIG. 1.
Figure 2A:
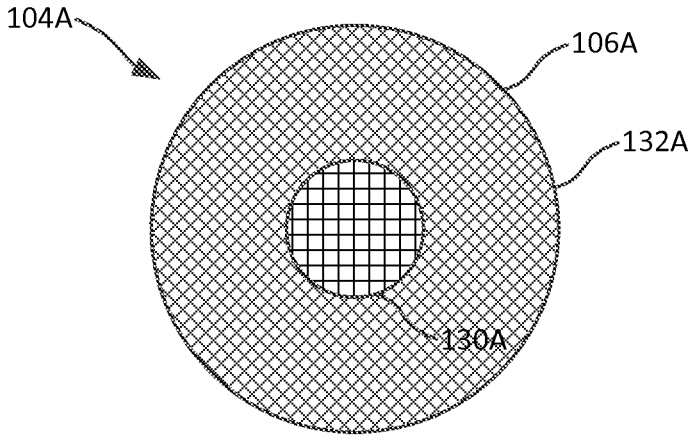
FIG. 2A illustrates a cross-sectional view of a first mascara applicator of the mascara device along line 2A-2A of FIG. 2.
Figure 2B:
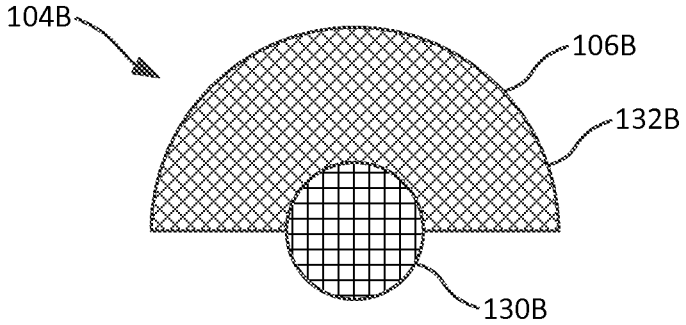
FIG. 2B illustrates a cross-sectional view of a second mascara applicator of the mascara device along line 2B-2B of FIG. 2.
Figure 3:
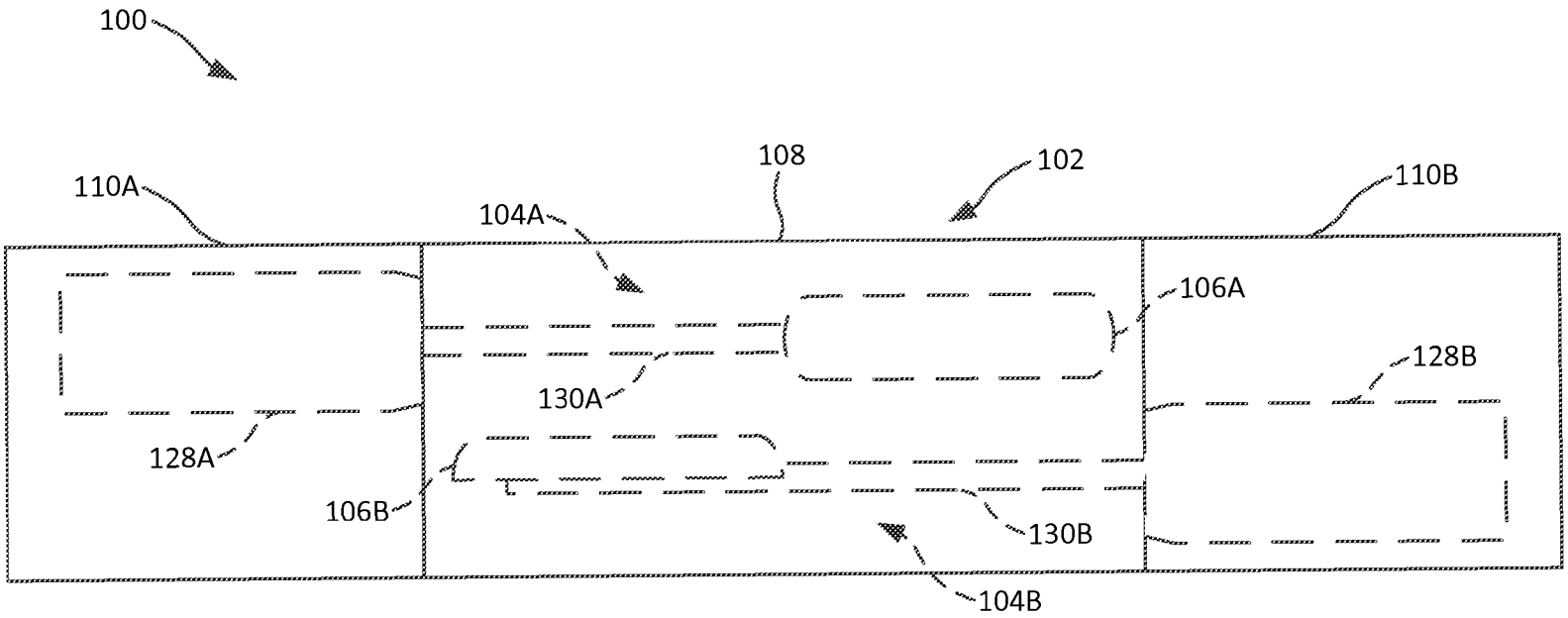
FIG. 3 illustrates a side view of the mascara device of FIG. 1; the first and second mascara applicators carried within a housing of the mascara device are shown in dashed lines.

FIGS. 1-3 illustrate a mascara device 100 according to an embodiment of the present invention. The mascara device 100 includes a housing 102 that removably carries a first mascara applicator 104A and a second mascara applicator 104B (see FIGS. 2 and 3). Generally, the first mascara applicator 104A has a first relatively-large applicator tip 106A (see FIGS. 2 and 3) for applying mascara to the upper eyelashes of a wearer, and the second mascara applicator 104B has a second relatively-small applicator tip 106B (see FIGS. 2 and 3) for applying mascara to the lower eyelashes of the wearer. The size of the applicator tip 106B facilitates maneuvering the tip 106B in the relatively-tight space between the lower eyelashes and the lower eyelid of the wearer. These aspects are described in further detail below.

The housing 102 generally includes a main housing portion 108 that removably carries a first cover or cap 110A and a second cover or cap 110B.

Referring specifically to FIGS. 2 and 3, the main housing portion 108 may include any of various appropriate materials, such as polymers and the like. The main housing portion 108 includes a first mascara-carrying chamber 112A and a second mascara-carrying chamber 112B. As the names imply, the first mascara-carrying chamber 112A and the second mascara-carrying chamber 112B carry mascara 114. The first mascara-carrying chamber 112A and the second mascara-carrying chamber 112B also removably carry the first mascara applicator 104A and the second mascara applicator 104B, respectively. In some embodiments, the first mascara-carrying chamber 112A and the second mascara-carrying chamber 112B are elongated along a first longitudinal axis 116A and a second longitudinal axis 116B, respectively, of the main housing portion 108. In some embodiments, the first longitudinal axis 116A and the second longitudinal axis 116B are parallel and offset from each other in a transverse direction (that is, a direction perpendicular to the axes 116A, 116B). In some embodiments, the first mascara-carrying chamber 112A and the second mascara-carrying chamber 112B include a first opening 118A and a second opening 118B, respectively, that face outwardly from the main housing portion 108 in a first direction and a second, opposite direction, respectively. Stated another way, in some embodiments, the first opening 118A and the second opening 118B are defined on a first side 120A and a second, opposite side 120B, respectively, of the main housing portion 108.

In some embodiments, the main housing portion 108 also includes a first balance portion 122A and a second balance portion 122B proximate the first opening 118A and the second opening 118B, respectively. The first balance portion 122A and the second balance portion 122B may have appropriate sizes and weights to balance the mascara device 100 when the main housing portion 108 carries the mascara applicators 104A and 104B.

Still referring to FIGS. 2 and 3, the first cap 110A and the second cap 110B, when carried by the main housing portion 108, obscure (1) the first mascara-carrying chamber 112A and the second mascara-carrying chamber 112B, respectively, and (2) the first mascara applicator 104A and the second mascara applicator 104B, respectively.

The first cap 110A and the second cap 110B may include any of various appropriate materials, such as polymers and the like. The first cap 110A and the second cap 110B include a first cap chamber 124A and a second cap chamber 124B, respectively. When the first cap 110A is carried by the main housing portion 108, the first cap chamber 124A receives a portion of the first mascara applicator 104A and the first balance portion 122A. When the second cap 110B is carried by the main housing portion 108, the second cap chamber 124B receives a portion of the second mascara applicator 104B and the second balance portion 122B.

The first cap 110A and the main housing portion 108 together define a first coupling interface 126A for removably coupling the first cap 110A and the main housing portion 108, and the second cap 110B and the main housing portion 108 together define a second coupling interface 126B for removably coupling the second cap 110B and the main housing portion 108. In some embodiments and as shown in the drawings, the first coupling interface 126A and the second coupling interface 126B are threaded surfaces. The first coupling interface 126A and the second coupling interface 126B may take various other forms, such as frictionally-coupled surfaces and the like.

Referring now to FIGS. 2, 2A, 2B, and 3, the first mascara applicator 104A and the second mascara applicator 104B include a first handle 128A and a second handle 128B, respectively, that may be grasped by a wearer when applying mascara via the first mascara applicator 104A and the second mascara applicator 104B, respectively. The first and second handles 128A and 128B may include any of various appropriate materials, such as polymers and the like. In some embodiments, the first and second handles 128A and 128B may have an approximately hemi-circular (meaning within ten percent of being hemi-circular) cross-sectional outer perimeter shape (see, for example, the first handle 128A as illustrated in FIG. 1).

The first handle 128A and the second handle 128B carry a first elongated shaft 130A and a second elongated shaft 130B, respectively. The first and second shafts 130A and 130B may include any of various appropriate materials, such as polymers and the like. The first shaft 130A and the second shaft 130B carry the first applicator tip 106A and the second applicator tip 106B, respectively, at or proximate ends opposite the first handle 128A and the second handle 128B, respectively.

In some embodiments, the first applicator tip 106A and the second applicator tip 106B are both defined by a plurality of bristles, such as polymer bristles or the like, that extend outwardly from the first shaft 130A and the second shaft 130B, respectively. The first applicator tip 106A and the second applicator tip 106B have a first cross-sectional outer perimeter shape 132A (see FIG. 2A) and a second cross-sectional outer perimeter shape 132B (see FIG. 2B), respectively. In some embodiments, the first cross-sectional outer perimeter shape 132A and the second cross-sectional outer perimeter shape 132B are defined by the plurality of bristles. In some embodiments, the second cross-sectional outer perimeter shape 132B is smaller than the first cross-sectional outer perimeter shape 132A, and the second cross-sectional outer perimeter shape 132B is a portion of the first cross-sectional outer perimeter shape 132A. In some embodiments, the second cross-sectional outer perimeter shape 132B is approximately half (meaning within ten percent of being half) of the first cross-sectional outer perimeter shape 132A. In some embodiments, the first cross-sectional outer perimeter shape 132A may be circular and the second cross-sectional outer perimeter shape 132B may be semi-circular. In some embodiments, the second cross-sectional outer perimeter shape 132B may be hemi-circular.

Figure 4:
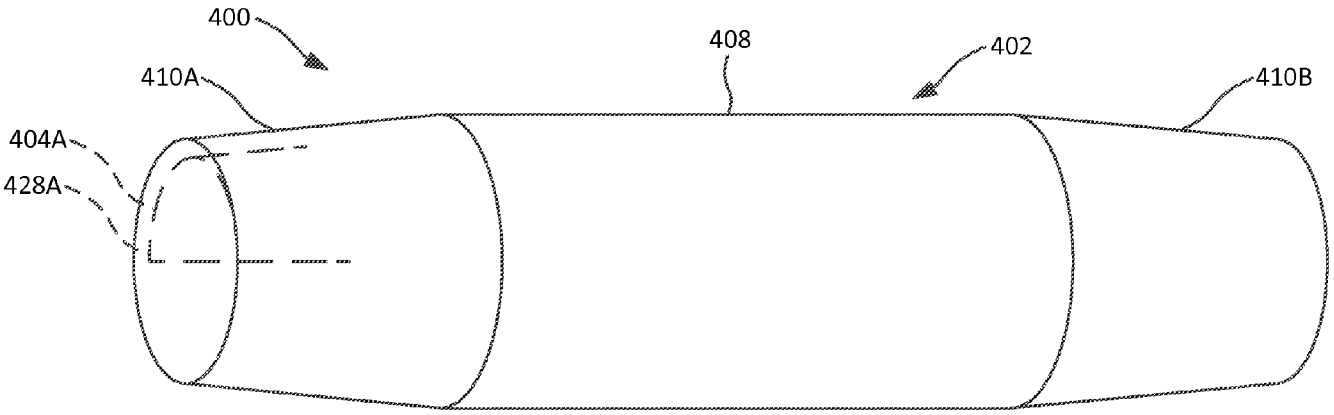
FIG. 4 illustrates a perspective view of a mascara device according to another embodiment of the present invention.
Figure 5:
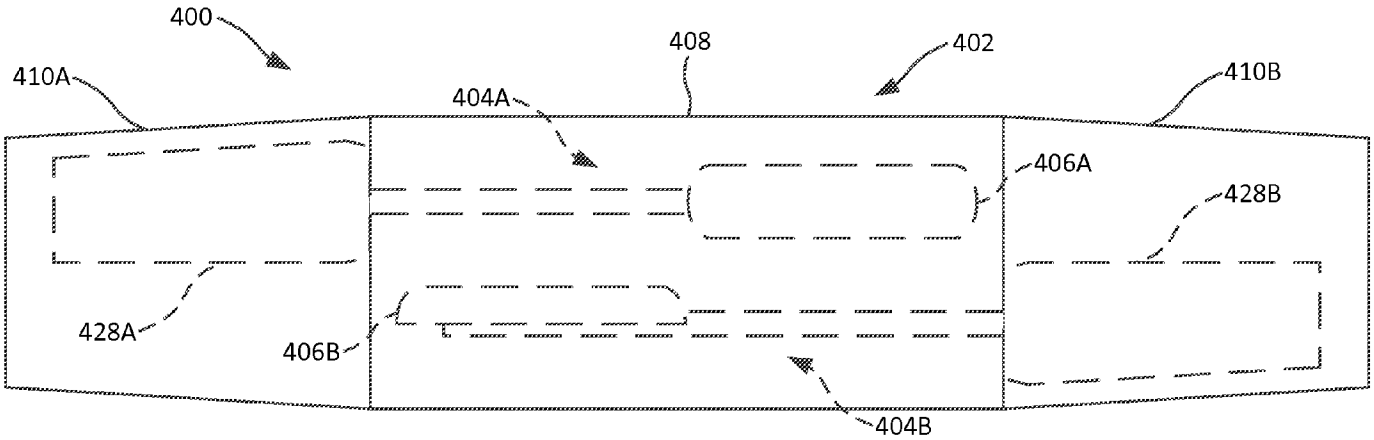
FIG. 5 illustrates a side view of the mascara device of FIG. 4; first and second mascara applicators carried within a housing of the mascara device are shown in dashed lines.
Figure 6:
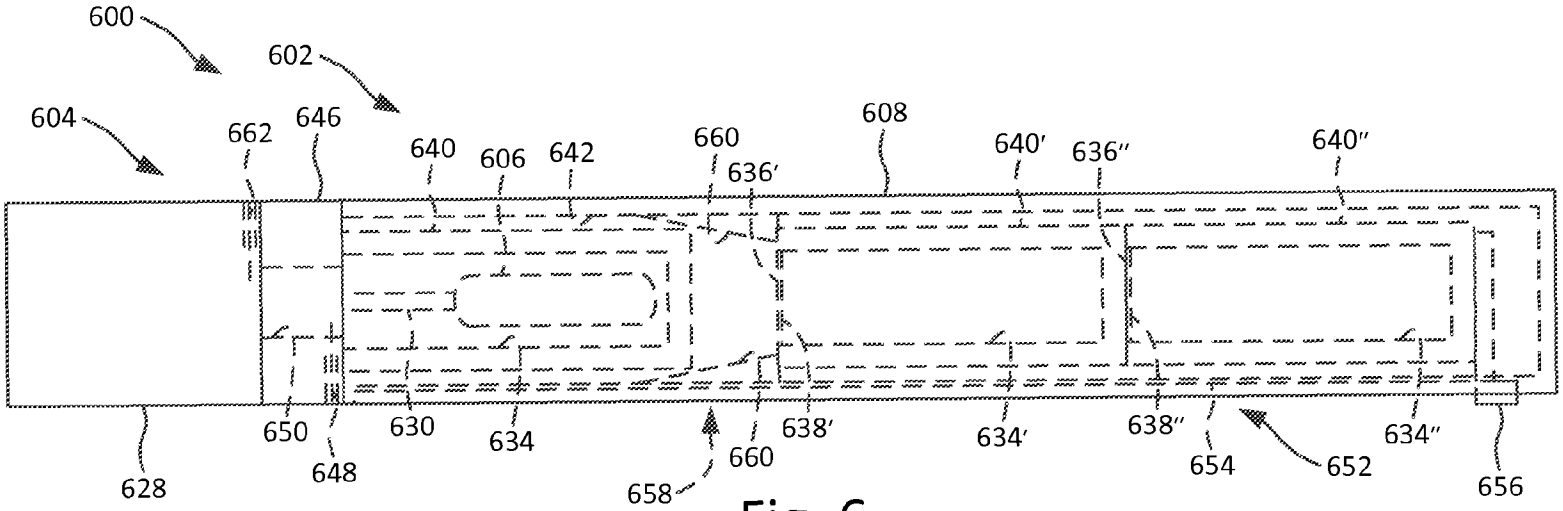
FIG. 6 illustrates a side view of a mascara device according to another embodiment of the present invention; internal features and components within the mascara device are shown in dashed lines.
Figure 7:
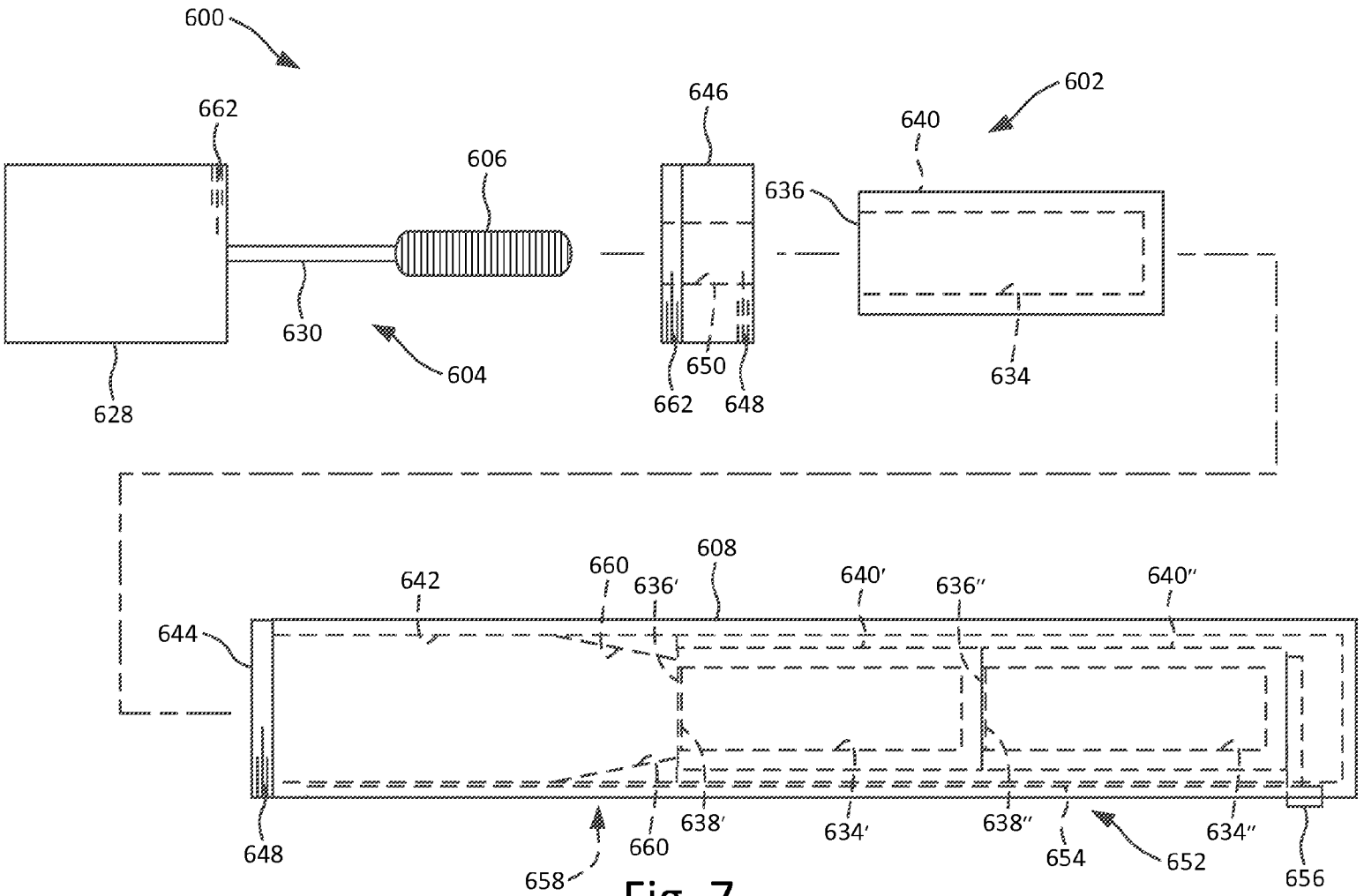
FIG. 7 illustrates a partially exploded side view of the mascara device of FIG. 6.

FIGS. 4 and 5 illustrate a mascara device 400 according to another embodiment of the present invention. The mascara device 400 may be similar to the mascara device 100 described above. Generally, the mascara device 400 includes a housing 402 that removably carries a first mascara applicator 404A and a second mascara applicator 404B. The first mascara applicator 404A has a first relatively-large applicator tip 406A for applying mascara to the upper eyelashes of a wearer, and the second mascara applicator 404B has a second relatively-small applicator tip 406B for applying mascara to the lower eyelashes of the wearer. The size of the applicator tip 406B facilitates maneuvering the tip 406B in the relatively-tight space between the lower eyelashes and the lower eyelid of the wearer.

The housing 402 includes a main housing portion 408 that removably carries a first cover or cap 410A and a second cover or cap 410B. The first cap 410A and the second cap 410B taper inwardly proceeding away from the main housing portion 408. The first mascara applicator 404A and the second mascara applicator 404B include a first handle 428A and a second handle 428B, respectively, that may be grasped by a wearer when applying mascara via the first mascara applicator 404A and the second mascara applicator 404B, respectively. Outer perimeter surfaces of the first handle 428A and the second handle 428B taper inwardly proceeding away from the main housing portion 408.

FIGS. 6-9 illustrate a mascara device 600 according to another embodiment of the present invention. Generally, the mascara device 600 includes a housing 602 that removably carries a mascara applicator 604. The housing 602 includes a main housing portion 608 that removably carries a first mascara-carrying cartridge 640. The first mascara-carrying cartridge 640 receives an applicator tip 606 of the mascara applicator 604. When the mascara supply of the first mascara-carrying cartridge 640 is depleted, the first mascara-carrying cartridge 640 may be removed from the main housing portion 608. A replacement cartridge (for example, a second mascara-carrying cartridge 640' or a third mascara-carrying cartridge 640") may be moved to a usage position to receive the applicator tip 606 of the mascara applicator 604. These aspects are described in further detail below.

Each mascara-carrying cartridge may include any of various appropriate materials, such as polymers and the like. Each mascara-carrying cartridge includes a mascara-carrying chamber. That is, the first mascara-carrying cartridge 640 includes a first mascara-carrying chamber 634, the second mascara-carrying cartridge 640' includes a second mascara-carrying chamber 634', and the third mascara-carrying cartridge 640" includes a third mascara-carrying chamber 634". Each mascara-carrying chamber includes a mascara-carrying chamber opening. That is, the first mascara-carrying chamber 634 includes a first mascara-carrying chamber opening 636 (see FIG. 7), the second mascara-carrying chamber 634' includes a second mascara-carrying chamber opening 636', and the third mascara-carrying chamber 634" includes a third mascara-carrying chamber opening 636". In some embodiments, each replacement cartridge (for example, the second mascara-carrying cartridge 640' and the third mascara-carrying cartridge 640") includes a seal positioned at or proximate the mascara-carrying chamber opening. That is, the second mascara-carrying cartridge 640' includes a seal 638' and the third mascara-carrying cartridge 640" includes a seal 638". The seals isolate the mascara and maintain freshness until the replacement chamber is moved to the usage position. Each seal may be removed before use when the replacement chamber is moved to the usage position.

The main housing portion 608 may include any of various appropriate materials, such as polymers and the like. The main housing portion 608 includes a main housing chamber 642 that removably carries the first mascara-carrying cartridge 640 and the replacement cartridge(s). The main housing chamber 642 includes a main housing chamber opening 644 (see FIGS. 7-9).

At the main housing chamber opening 644, the main housing portion 608 removably carries a cartridge-retaining component 646. The cartridge-retaining component 646 and the main housing portion 608 together define a first coupling interface 648 for removably coupling the cartridge-retaining component 646 and the main housing portion 608. In some embodiments and as shown in the drawings, the first coupling interface 648 includes threaded surfaces. The first coupling interface 648 may take various other forms, such as frictionally-coupled surfaces and the like.

Although the mascara device 600 is described and depicted as including two replacement mascara-carrying cartridges, it is contemplated that the device 600 may include a different number of replacement cartridges. That is, the mascara device 600 may include one replacement mascara-carrying cartridge or three or more replacement mascara-carrying cartridges.

The cartridge-retaining component 646 may include any of various appropriate materials, such as polymers and the like. The cartridge-retaining component 646 includes a passageway 650 that extends therethrough. The passageway 650 is sufficiently large such that, when the cartridge-retaining component 646 is carried by the main housing portion 608, the applicator tip 606 is permitted to extend through the passageway 650 and is received by the first mascara-carrying chamber 634. In addition, the passageway 650 is sufficiently small such that, when the cartridge-retaining component 646 is carried by the main housing portion 608, the cartridge-retaining component 646 inhibits the first mascara-carrying cartridge 640 from being removed from the main housing portion 608. When the cartridge-retaining component 646 is removed from the main housing portion 608, the first mascara-carrying cartridge 640 (or the second mascara-carrying cartridge 640' or so forth) may be removed from the main housing portion 608 through the main housing chamber opening 644.

In some embodiments, the main housing portion 608 also carries an actuation mechanism 652. When the cartridge-retaining component 646 is removed from the main housing portion 608, the actuation mechanism 652 may be actuated to move a replacement cartridge (for example, the second mascara-carrying cartridge 640') away from a storage position (for example, an initial position of the second mascara-carrying cartridge 640'). Actuation of the actuation mechanism 652 thereby displaces the mascara-carrying cartridge (for example, the first mascara-carrying cartridge 640) away from a usage position (that is, a position in which a cartridge receives the applicator tip 606 with its mascara-carrying chamber, or the initial position of the first mascara-carrying cartridge 640) and through the main housing chamber opening 644 to eject the cartridge from the main housing portion 640.

Figure 8:
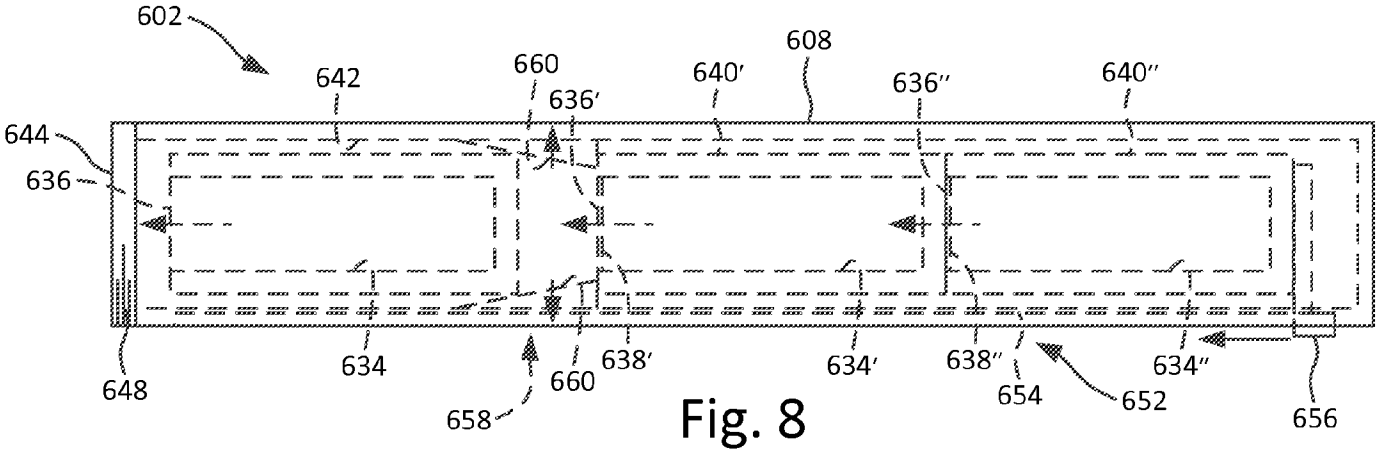
FIG. 8 illustrates a side view of a housing of the mascara device of FIG. 6 in which a first mascara-carrying cartridge is ejected from the housing and a replacement cartridge is moved from a storage position to a usage position.
Figure 9:
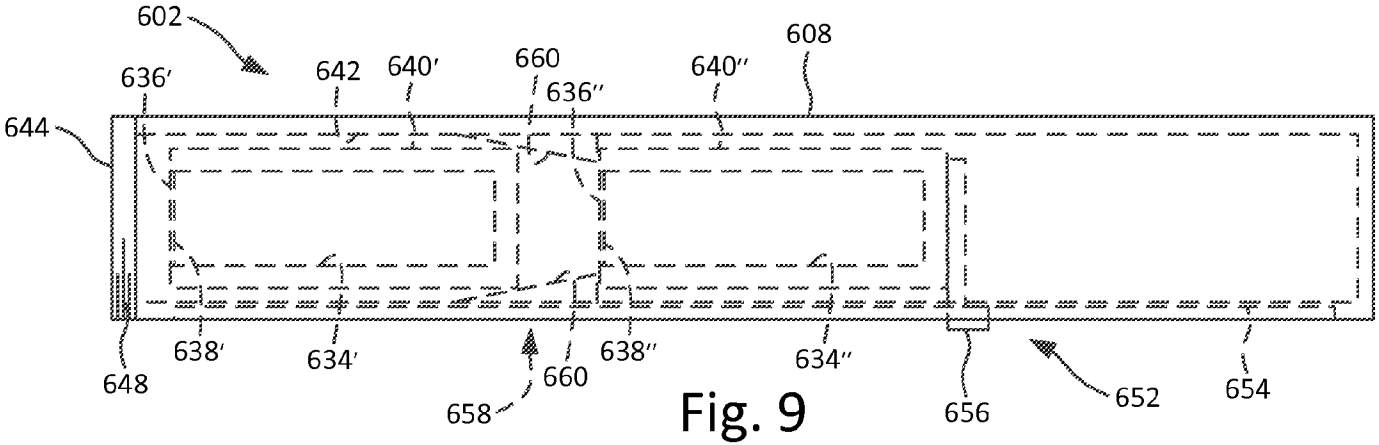
FIG. 9 illustrates a side view of the housing of the mascara device of FIG. 6 in which the first mascara-carrying cartridge has moved from the storage position to the usage position.

In some embodiments, the actuation mechanism 652 includes a slot 654 formed in the wall of the main housing portion 608 and a button 656 translatably carried in the slot 654. The button 656 extends into the main housing chamber 642 and engages a replacement cartridge (for example, the third mascara-carrying cartridge 640") on a side that faces away from the main housing chamber opening 644. Referring specifically to FIGS. 8 and 9, when the mascara supply of the first mascara-carrying chamber 634 is depleted, the wearer may translate the button 656 toward the main housing chamber opening 644 to move the second mascara-carrying cartridge 640' from the storage position to the usage position and thereby eject the first mascara-carrying cartridge 640 from the main housing portion 608. Thereafter, and when the mascara supply of the second mascara-carrying chamber 634' is depleted, the user may translate the button 656 toward the main housing chamber opening 644 to move the third mascara-carrying cartridge 640" from the storage position to the usage position and thereby eject the second mascara-carrying cartridge 640' from the main housing portion 608.

In some embodiments, the main housing portion 608 also cartridge motion-limiting mechanism 658. The cartridge motion-limiting mechanism 658 permits replacement cartridges (for example, the second mascara-carrying cartridge 640' or the third mascara-carrying cartridge 640") to move from the storage positions to the usage position. The cartridge motion-limiting mechanism 658 also inhibits the replacement cartridges from moving from the usage position toward the storage position.

In some embodiments, the cartridge motion-limiting mechanism 658 includes a plurality of prongs 660 carried by the main housing portion 608 within the main housing chamber 642. Although the drawings illustrate two prongs 660, it is contemplated that the mascara device 600 may include a different number of prongs 660. For example, the mascara device 600 may include one prong 660, three prongs 660, four prongs 660, or more prongs 660. As shown in FIG. 8, the prongs 660 deflect to permit replacement cartridges (for example, the second mascara-carrying cartridge 640' or the third mascara-carrying cartridge 640") to move from the storage positions to the usage position. The prongs 660 also remain stationary to inhibit the replacement cartridges from moving from the usage position toward the storage position.

The mascara applicator 604 includes a handle 628 that may be grasped by a wearer when applying mascara via the mascara applicator 604. The handle 628 includes any of various appropriate materials, such as polymers and the like. The handle 628 and the cartridge-retaining component 646 together define a second coupling interface 662 for removably coupling the handle 628 and the cartridge-retaining component 646. In some embodiments and as shown in the drawings, the second coupling interface 662 includes threaded surfaces. The second coupling interface 662 may take various other forms, such as frictionally-coupled surfaces and the like.

The handle 628 carries an elongated shaft 630. The shaft 630 may include any of various appropriate materials, such as polymers and the like. The shaft 630 carries the applicator tip 606 at or proximate an end opposite the handle 628. In some embodiments, the applicator tip 606 is defined by a plurality of bristles, such as polymer bristles or the like, that extend outwardly from the shaft 630.

Figure 10:
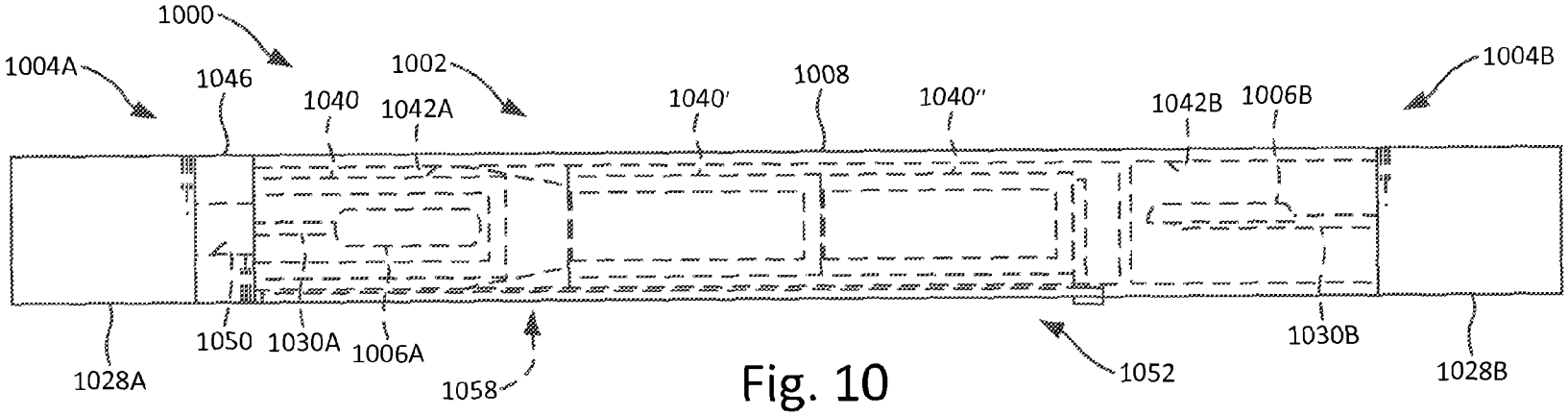
FIG. 10 illustrates a side view of a mascara device according to another embodiment of the present invention; internal features and components within the mascara device are shown in dashed lines.

FIG. 10 illustrates a mascara device 1000 according to another embodiment of the present invention. The mascara device 1000 may be similar to the mascara device 600 described above. Generally, the mascara device 1000 includes a housing 1002 that removably carries a first mascara applicator 1004A. The housing 1002 includes a main housing portion 1008 that removably carries a first mascara-carrying cartridge 1040 within a main housing chamber 1042A. The first mascara-carrying cartridge 1040 receives a first applicator tip 1006A of the first mascara applicator 1004A. When the mascara supply of the first mascara-carrying cartridge 1040 is depleted, the first mascara-carrying cartridge 1040 may be removed from the main housing portion 1008. A replacement cartridge (for example, a second mascara-carrying cartridge 1040' or a third mascara-carrying cartridge 1040") may be moved from a storage position to a usage position to receive the applicator tip 1006A of the mascara applicator 1004A.

Although the mascara device 1000 is described and depicted as including two replacement mascara-carrying cartridges, it is contemplated that the device 1000 may include a different number of replacement cartridges. That is, the mascara device 1000 may include one replacement mascara-carrying cartridge or three or more replacement mascara-carrying cartridges.

The mascara device 1000 may include a cartridge-retaining component 1046, which may be similar to the cartridge-retaining component 646 described above. Generally, the cartridge-retaining component 1046 includes a passageway 1050 that extends therethrough. The passageway 1050 is sufficiently large such that, when the cartridge-retaining component 1046 is carried by the main housing portion 1008, the first applicator tip 1006A is permitted to extend through the passageway 1050 and is received by the first mascara-carrying cartridge 1040. In addition, the passageway 1050 is sufficiently small such that, when the cartridge-retaining component 1046 is carried by the main housing portion 1008, the cartridge-retaining component 1046 inhibits the first mascara-carrying cartridge 1040 from being removed from the main housing portion 1008. When the cartridge-retaining component 1046 is removed from the main housing portion 1008, the first mascara-carrying cartridge 1040 (or the second mascara-carrying cartridge 1040' or so forth) may be removed from the main housing portion 1008 through a main housing chamber opening (not shown).

The mascara device 1000 may include an actuation mechanism 1052, which may be similar to the actuation mechanism 652 described above. Generally, when the cartridge-retaining component 1046 is removed from the main housing portion 1008, the actuation mechanism 1052 may be actuated to move a replacement cartridge (for example, the second mascara-carrying cartridge 1040') away from a storage position (for example, an initial position of the second mascara-carrying cartridge 1040'). Actuation of the actuation mechanism 1052 thereby displaces the mascara-carrying cartridge (for example, the first mascara-carrying cartridge 1040) away from a usage position (that is, a position in which a cartridge receives the first applicator tip 1006A with its mascara-carrying chamber, or the initial position of the first mascara-carrying cartridge 1040) and through the main housing chamber opening to eject the cartridge from the main housing portion 1040.

The mascara device 1000 may include a cartridge motion-limiting mechanism 1058, which may be similar to the cartridge motion-limiting mechanism 658 described above. Generally, the cartridge motion-limiting mechanism 1058 permits replacement cartridges (for example, the second mascara-carrying cartridge 1040' or the third mascara-carrying cartridge 1040") to move from the storage positions to the usage position. The cartridge motion-limiting mechanism 1058 also inhibits the replacement cartridges from moving from the usage position toward the storage position.

The first mascara applicator 1004A may be similar to the first mascara applicator 104A described above. Generally, the first mascara applicator 1004A includes a first handle 1028A that may be grasped by a wearer when applying mascara via the first mascara applicator 1004A. The first handle 1028A carries a first elongated shaft 1030A, which in turn carries the first applicator tip 1006A at or proximate an end opposite the first handle 1028A.

The main housing portion 1008 also includes a secondary housing chamber 1042B that carries mascara. The secondary housing chamber 1042B receives a second applicator tip 1006B of a second mascara applicator 1004B. The second mascara applicator 1004B may be similar to the second mascara applicator 104B described above. Generally, the second mascara applicator 1004B includes a second handle 1028B that may be grasped by a wearer when applying mascara via the second mascara applicator 1004B. The second handle 1028B carries a second elongated shaft 1030B, which in turn carries the second applicator tip 1006B at or proximate an end opposite the second handle 1028B.

The first applicator tip 1006A and the second applicator tip 1006B have a first cross-sectional outer perimeter shape and a second cross-sectional outer perimeter shape, respectively. In some embodiments, the second cross-sectional outer perimeter shape is smaller than the first cross-sectional outer perimeter shape, and the second cross-sectional outer perimeter shape is a portion of the first cross-sectional outer perimeter shape. In some embodiments, the second cross-sectional outer perimeter shape is approximately half (meaning within ten percent of being half) of the first cross-sectional outer perimeter shape. In some embodiments, the first cross-sectional outer perimeter shape may be circular and the second cross-sectional outer perimeter shape may be semi-circular. In some embodiments, the second cross-sectional outer perimeter shape may be hemi-circular.

The secondary housing chamber 1042B includes a secondary housing chamber opening (not shown). In some embodiments, the main housing chamber opening and the secondary housing chamber opening face outwardly from the main housing portion 1008 in a first direction and a second, opposite direction, respectively.

In some embodiments, the first mascara applicator 1004A and the second mascara applicator 1004B are interchangeably carried by the main housing portion 1008. That is, the first mascara applicator 1004A may be carried by the main housing portion 1008 such that the first applicator tip 1006A is received in the secondary housing chamber 1042B, and the second mascara applicator 1006B may be carried by the main housing portion 1008 such that the second applicator tip 1006B is received by one of the mascara-carrying cartridges.

Embodiments of mascara devices according to the present invention may take various other forms that are not explicitly described above. For example, the mascara device 1000 may include applicator handles 1028A and 1028B that taper inwardly proceeding away from the main housing portion 1008. As another example, the mascara device 100 may include a main housing portion 108 that carries the applicator tips 106A and 106B, and the first and second caps 110A and 110B may include the first and second mascara-carrying chambers 112A and 112B, respectively.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

What is claimed is:

1. A mascara device, comprising:

a housing comprising:

a main housing portion comprising a main housing chamber;

a first cartridge removably carried by the main housing portion within the main housing chamber, the first cartridge comprising a first mascara-carrying chamber;

a second cartridge removably carried by the main housing portion within the main housing chamber, the second cartridge comprising a second mascara-carrying chamber; and a mascara applicator comprising an applicator tip adapted to apply mascara to eyelashes of a wearer;

wherein the first mascara-carrying chamber receives the applicator tip when the first cartridge is carried by the main housing portion, and the second mascara-carrying chamber receives the applicator tip when the first cartridge is removed from the main housing portion;

wherein the first cartridge selectively occupies a usage position relative to the main housing portion, in the usage position the first mascara-carrying chamber receiving the applicator tip, the second cartridge being movable to the usage position when the first cartridge is removed from the main housing portion, and in the usage position the second mascara-carrying chamber receiving the applicator tip.

2. The mascara device of claim 1, wherein the second cartridge occupies a storage position when the first cartridge occupies the usage position, the main housing portion further comprises a cartridge motion-limiting mechanism within the main housing chamber, the cartridge motion-limiting mechanism comprising at least one prong that (1) deflects to permit the second cartridge to move from the storage position to the usage position, and (2) remains stationary to inhibit the second cartridge from moving from the usage position toward the storage position.

3. The mascara device of claim 2, wherein the housing further comprises an actuation mechanism carried by the main housing portion, the actuation mechanism being actuatable to move the second cartridge from the storage position to the usage position and thereby eject the first cartridge from the main housing chamber.

4. The mascara device of claim 3, wherein the actuation mechanism comprises a button, and the actuation mechanism is actuatable by translating the button relative to the main housing portion.

5. The mascara device of claim 1, wherein the housing further comprises a cartridge-retaining component removably carried by the main housing portion, the cartridge-retaining component comprising a passageway extending therethrough, when carried by the main housing portion the cartridge-retaining component inhibiting the first cartridge from being removed from the main housing portion and permitting the mascara applicator to extend through the passageway such that the applicator tip is received in the first mascara-carrying chamber, and when removed from the main housing portion the cartridge-retaining component permitting the first cartridge to be removed from the main housing portion.

* * * * *